United States Patent [19]

Fleissner

[11] 4,101,270

[45] Jul. 18, 1978

[54] PROCESS AND APPARATUS FOR THE CONTINUOUS DYEING OR PRINTING OF ENDLESS LENGTHS OF MATERIALS

[75] Inventor: Hans Fleissner, Basel, Switzerland

[73] Assignee: Vepa Aktiengesellschaft, Switzerland

[21] Appl. No.: 588,834

[22] Filed: Jun. 20, 1975

[51] Int. Cl.[2] ..... D06P 7/00; D06B 5/08; D06C 7/02

[52] U.S. Cl. ..... 8/17; 8/1 XB; 8/130.1; 8/DIG. 15; 68/5 C

[58] Field of Search ..... 8/1 XB, 17, 130.1, DIG. 15; 68/5

[56] References Cited

U.S. PATENT DOCUMENTS

| | | | |
|---|---|---|---|
| 2,157,119 | 5/1939 | Miles | 8/DIG. 21 |
| 2,524,119 | 10/1950 | Van Heek | 8/1 XB |
| 2,815,558 | 12/1957 | Bartovics et al. | 8/1 XB |
| 3,010,179 | 11/1961 | Thal | 8/1 XB |
| 3,024,518 | 3/1962 | Newton | 8/1 XB |
| 3,128,528 | 4/1964 | Magel | 8/130.1 X |
| 3,622,372 | 11/1971 | Ishida | 8/130.1 |

*Primary Examiner*—John Kight, III

*Attorney, Agent, or Firm*—Craig & Antonelli; Craig & Antonelli

[57] ABSTRACT

An improved process for the continuous dyeing or printing of lengths of textile material, especially tufted carpet panels, having backing materials which are subjected to at least partially a change in length during a dye fixation process of the pile portion of the textile material under saturated steam conditions, the process including the step of setting the fibers making up the backing material prior to applying dye to the pile fibers.

8 Claims, 1 Drawing Figure

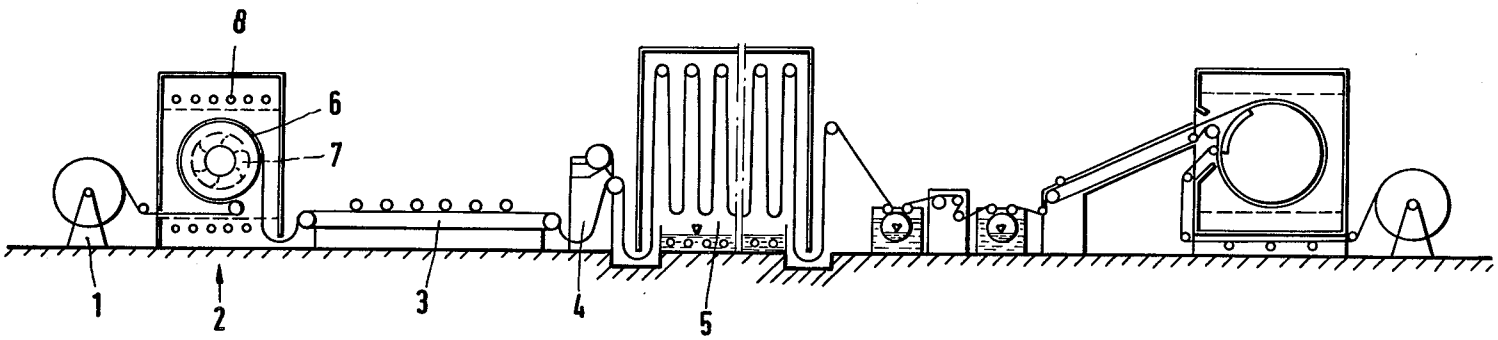
1
2
3
4
5
6
7
8

PROCESS AND APPARATUS FOR THE CONTINUOUS DYEING OR PRINTING OF ENDLESS LENGTHS OF MATERIALS

The present invention relates especially to a process for the continuous dyeing or printing of sheets such as, in particular, tufted carpet panels, the backing materials of which are subjected at least partially to a change in length, especially to shrinkage, during the dye fixation process of, for example, the pile under saturated steam conditions, and which are exposed to a steam treatment for wetting purposes before the dyes or printing pastes are applied.

It is known to subject carpet panels to a preliminary steaming step upstream of the printing machine and/or the dye applicator to obtain a certain moistening of the material and optionally also to partially relax the sheet of material. This procedure is to remove slight, unilateral stretching and nonuniformities in the backing fabric. Otherwise, such flaws lead to a one-sided shrinkage of the sheet of material and also to crease formation during the subsequent steaming process carried out to fix the dyes. Particularly in a traveling loop steamer, the conductance of the material becomes problematical.

Steam boxes are known as a preliminary steaming unit, which operate with saturated steam or to which can also be fed direct steam having a steam temperature of around 100° C. The preliminary steaming step brought partial success which, however, resided essentially in a preliminary wetting of the material for the subsequent dye application step.

The invention is based on the problem of developing a process wherein the material is with certainty not only prepared for a dye application step without any problems, but is also subjected to a pretreatment preventing to an extent of 100% the shrinkage of the carpet panels and the formation of longitudinal creases in the steamer.

Starting with the process as described hereinabove, the solution resides in that the shrinkable fibers of the material are set prior to the dye application. This fixing (setting) step can be executed under tension, but in any event the material must be exposed to heat which can consist of steam or air. It is advantageous to heat the gaseous medium to temperatures of higher than 100° C., i.e. higher than the fixation temperature of the dyes. The preliminary setting temperature of the material depends on the compatibility of the backing material. The preliminary setting temperature should, therefore, be at least 105° C. However, since the normal carrier fabrics consist of polypropylene, temperatures of between 120° and 130° C. are desirable. Superheated steam is unsuitable for polypropylene; rather air heated to the aforementioned temperature should be used in this connection.

To make it possible to set the backing material within a short period of time, it is very advantageous to draw the heated gaseous medium by suction through the carpet panels with vigorous circulation with the aid of a venting action. Suitable for this purpose is advantageously a sieve drum unit which must be disposed upstream of the dye application units.

The drawing illustrates one embodiment of the apparatus according to this invention.

The system consists of an inlet station 1, a sieve drum unit 2 disposed thereafter, followed by systems for dye application, such as a roller printing machine 3 and/or a dye applicator 4. Downstream thereof is a steamer 5 which can be constructed as a traveling loop steamer or a horizontal steamer. After the fixation of the dye, the material is washed and finally dried. For the washing and drying steps, the most effective type of treatment is to pass the respective treatment medium through the material.

The sieve drum unit 2 in front of the dye applicator 3, 4 consists of a single drum 6 associated at its end face with a fan 7 to produce the suction draft. The heating systems 8 are designed so that temperatures of up to at least 130°-140° C. can be generated. The length of material travels over the drum so that its backside rests on the drum surface, i.e. the pile does not come into contact with guide elements during the high-temperature treatment, thus avoiding a deformation of the pile.

What is claimed is:

1. A process for the continuous dyeing or printing of a length of textile material having pile fibers on one side and a backing material on the other side, said backing material being made of shrinkable fibers which will be subjected to a change in length during fixation of dye to the pile fibers under saturated steam conditions, which comprises, successively, passing the length of textile material through a setting zone under tension, treating the fibers making up the backing material with a gaseous medium heated to a setting temperature for the shrinkable fibers during passage of the length of textile material through said setting zone, said backing material being heat-set in said setting zone by passing the textile material over a perforated surface of a sieve drum means with the backing material resting on the surface of the sieve drum means and by drawing the heated gaseous medium by suction through said textile material on the perforated surface of said sieve drum means, then passing the heat-treated length of textile material into a dye application system to apply dye to said pile fibers, and thereafter fixing the dye to said pile fibers by passing the dye-containing length of textile material through a zone wherein the length of textile material is subjected to saturated steam conditions.

2. A process according to claim 1, wherein the gaseous medium for the setting of the backing material is steam.

3. A process according to claim 1, wherein the gaseous medium for the setting of the backing material is air.

4. A process according to claim 1, wherein the gaseous medium is heated to temperatures higher than 100° C. and higher than the fixation temperature of the dye applied to said pile fibers.

5. A process according to claim 4, wherein the backing material is subjected to setting conditions depending on the compatibility of the fibers forming said backing material, the temperature of the gaseous medium being at least 105° C.

6. A process according to claim 1, wherein the length of textile material is a tufted carpet panel and the shrinkable fibers are synthetic fibers and the setting temperature of the heated gaseous medium is from 120° to 130° C.

7. The process according to claim 1, wherein the gaseous medium is steam or air.

8. The process according to claim 1, wherein the gaseous medium is air, the backing material is made of polypropylene and the setting temperature is from 120° to 130° C.

* * * * *